United States Patent [19]

Bianchi et al.

[11] Patent Number: 4,645,103

[45] Date of Patent: Feb. 24, 1987

[54] FABRIC HOLSTER WITH UNIVERSALLY ADJUSTABLE STRAP

[75] Inventors: John E. Bianchi; Wayne B. Gregory, both of Temecula; Richard D. E. Nichols, Fallbrook, all of Calif.

[73] Assignee: Bianchi International, Temecula, Calif.

[21] Appl. No.: 614,286

[22] Filed: May 25, 1984

[51] Int. Cl.[4] ..... F41C 33/02

[52] U.S. Cl. ..... 224/243; 224/192; 224/911

[58] Field of Search ..... 224/192, 238, 243, 911, 224/912

[56] References Cited

U.S. PATENT DOCUMENTS

| | | | |
|---|---|---|---|
| 3,406,884 | 10/1968 | Perkins | 224/911 X |
| 3,865,289 | 2/1975 | Boren | 224/243 X |
| 3,942,692 | 3/1976 | Chica | 224/911 X |
| 4,286,741 | 9/1981 | Rogers | 224/911 X |
| 4,298,150 | 11/1981 | Seldeen | 224/911 X |
| 4,312,466 | 1/1982 | Clark | 224/192 X |
| 4,485,947 | 12/1984 | Cook . | |
| 4,485,948 | 12/1984 | Cook . | |

*Primary Examiner*—Stephen Marcus
*Assistant Examiner*—Robert M. Petrik
*Attorney, Agent, or Firm*—Wagner & Middlebrook

[57] ABSTRACT

An improved holster comprising a sheet of compressible material or a composite including a compressible layer formed into a pouch to hold a handgun with an edge seam at the rear. At the front inside of the holster is a stiffener member secured to the holster sheet material by at least one generally vertical stitch line. The stitch line distorts the compressible material and the stiffening member to form a front groove for receiving the barrel and front sight of the handgun. A protective sleeve may cover the stiffener. An improved universally adjustable strap arrangement includes hook and pile type fabric on an inner face of a belt loop formed in the holster body and the mating hook and pile material on one face of the flat strap. The angle and length of the strap may be adjusted by relative movement of the strap within the belt loop. Securement of one end of the strap results from engagement of the hook and pile fabric and is insured by pressure from the wearer's belt when worn.

14 Claims, 24 Drawing Figures

Fig. 4
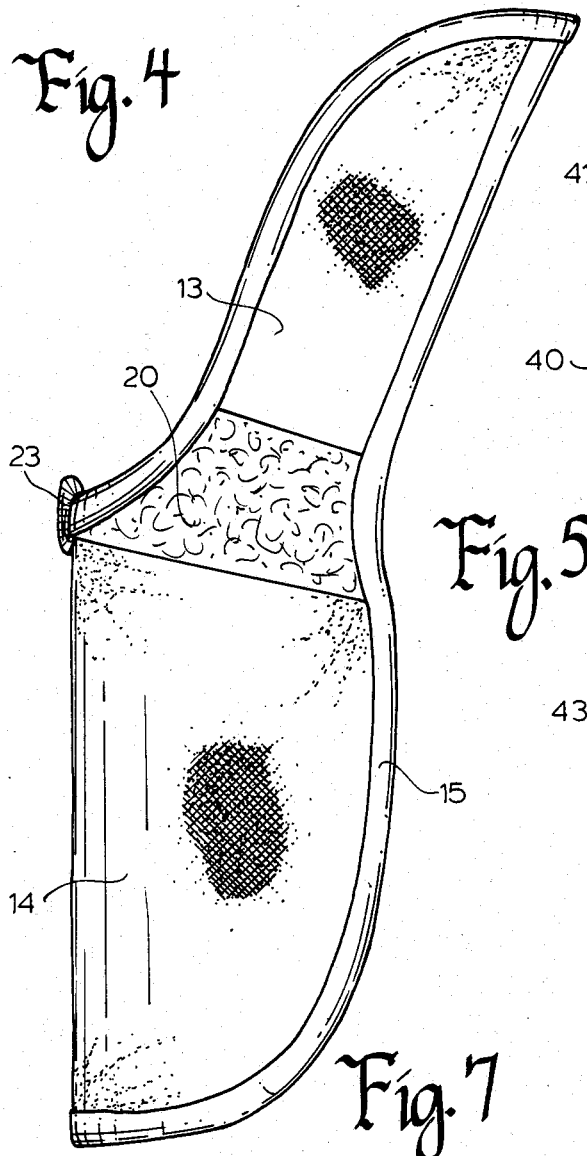
Fig. 5
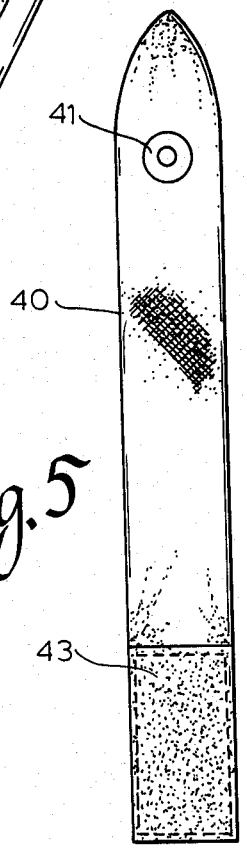
Fig. 6
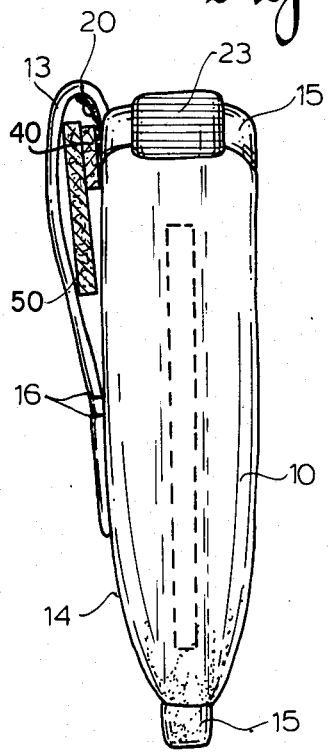
Fig. 7
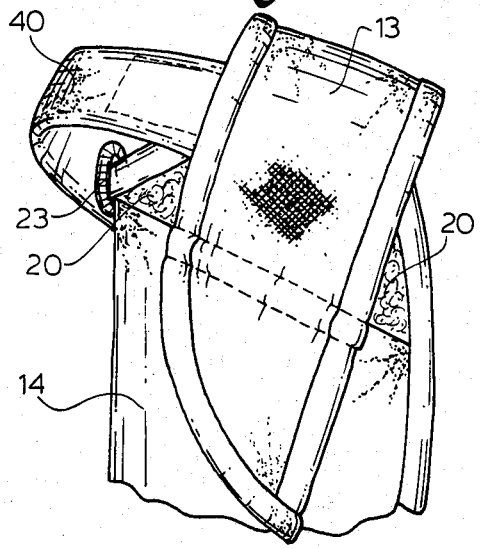
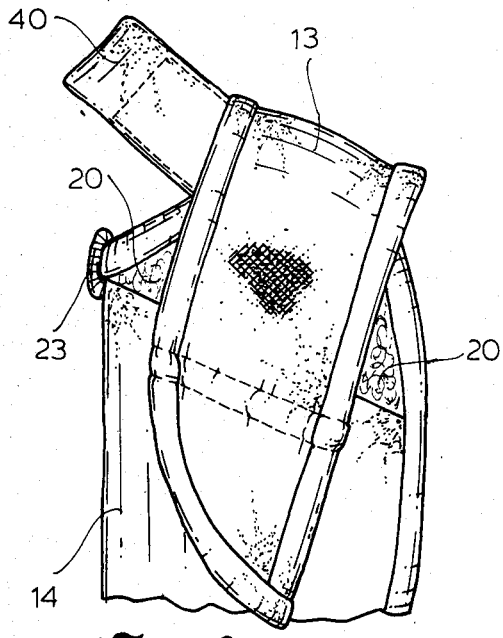
Fig. 8

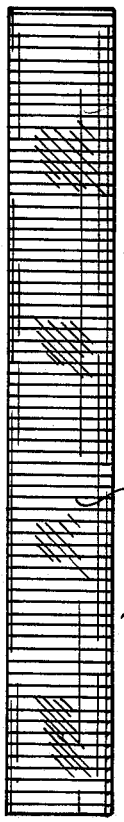
Fig. 9
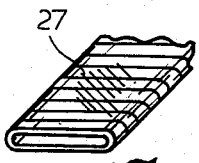
Fig. 10
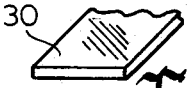
Fig. 12
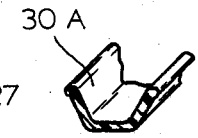
Fig. 12A
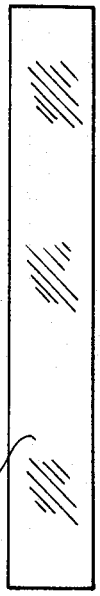
Fig. 11
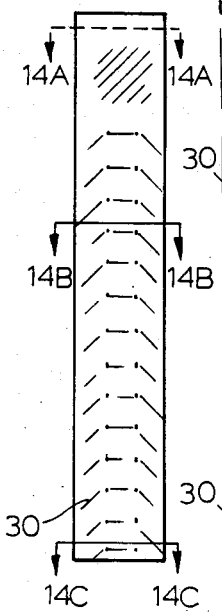
Fig. 13
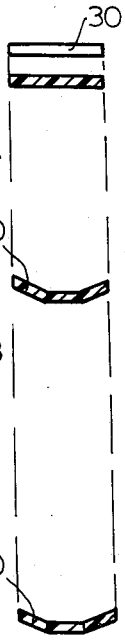
Fig. 14A
Fig. 14B
Fig. 14C
Fig. 16
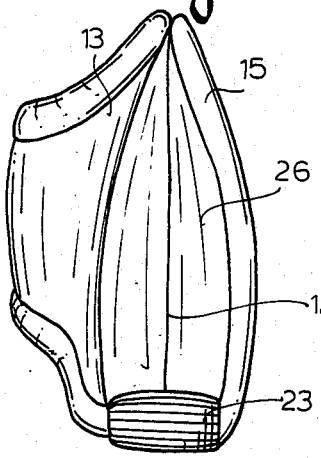
Fig. 13A
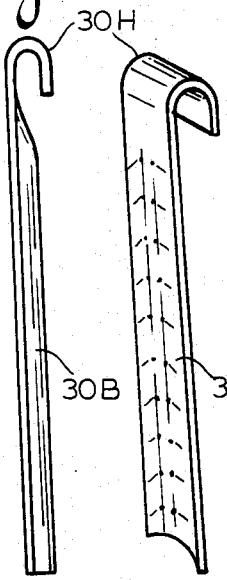
Fig. 15
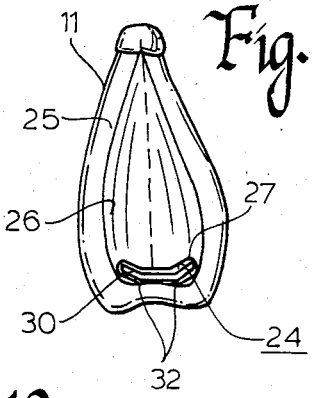
Fig. 17
Fig. 18
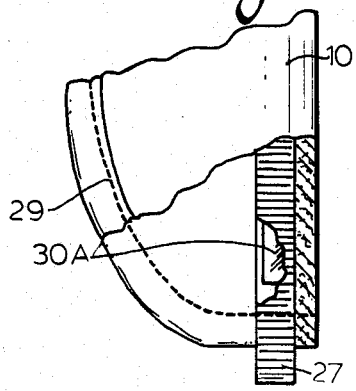
Fig. 19
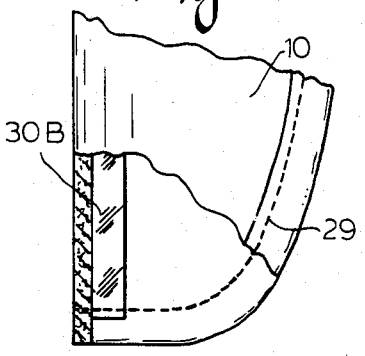

FABRIC HOLSTER WITH UNIVERSALLY ADJUSTABLE STRAP

BACKGROUND OF THE INVENTION

The handgun holster has gone through many stages of evolution from a simple leather pouch to sophisticated spring closed formed leather structures designed to protect valuable handguns, and in the case of law enforcement holsters to allow for rapid drawing by the officer alone. In many cases, these holsters are designed for complete concealment. Examples of such sophisticated leather holsters may be seen in U.S. Pat. Nos. 4,346,827, 4,277,077, 4,270,680 and 4,255,067, assigned to the assignee of this invention.

For almost a century, fabric holsters have been manufactured, particularly for military use. Typical materials used were duck or canvas, or webbing of the general type used in the well known military web belt. Examples of such holsters appear in U.S. Pat. Nos. 787,852 and 1,102,195.

Fabric holsters of the canvas or web material type were functionally acceptable in carrying a handgun, but were unattractive, show wear, and have interior surfaces which tend to remove any surface finish of the handgun. They particularly did not form about the handgun, as does leather, and therefore allowed for relative movement of the handgun in the holster thereby promoting wear of the material and of the surface of the handgun.

Recently composite fabric-foam-fabric materials have become available which eliminate the disadvantages noted for previous holster fabrics. These materials include an outer fabric such as ballistic nylon, a closed cell foam layer which provides resiliency and a degree of stiffness, and an inner fabric layer which may be coated, but is nonabrasive with respect to the handgun finish. This type of fabric composite has, since becoming available, been adopted by holster makers by reason of its inherently desirable properties.

Loop and pile fasteners, commonly known by the trademark "Velcro", have become known for use in holsters as represented by U.S. Pat. No. 4,312,466 exhibiting a degree of adjustability of straps.

BRIEF DESCRIPTION OF THE INVENTION

Faced with this state of the art, we have designed an improved holster using composite fabric material having a number of unforeseen advantages. Specifically, we have designed a holster with greater stiffness than a composite fabric holster which, in the stiffening process, produces a sight protecting groove as well. Further, using correctly placed hook and pile fabric, we have been able to produce a universal strap which is adjustable in both length and position for whichever handgun the user selects to use. We have further devised a strap arrangment using loop and pile fastener material in which the very act of wearing the holster insures that the strap remains in the selected position nearly as firmly as if permanently sewn in place or otherwise permanently secured.

Whenever the holster is removed from the wearer's belt, the strap may be easily adjusted in both length and position.

These features are achieved in a holster comprising a sheet of composite fabric formed to define a holster shape including a pouch for holding a handgun. The holster includes a belt loop and an area of one part of a two part hook and pile fastener secured to the outer surface of the holster body within the belt loop. The opposite side of the holster body includes a fastener such as a snap fastener or may be of hook and pile fabric. A strap includes one fastener part or hook or pile fastener at one end region, and the mating hook and pile fastener part at the opposite end region. The latter end of the strap is insertable in the belt loop region with the hook and pile parts juxtaposed. The strap is adjusted in angle and length to match the particular handgun sought to be carried so that the snap fastener pairs close with the proper tension over the handgun. The holster may then be placed on a belt and the act of wearing causes the belt to bear against the strap in the region of the hook and pile fabric parts holding them in unmoving relationship.

Within the holster is a stiffener member which is in the form of a planar strip having a stiffness greater than the stiffness of the holster body. The strip extends generally parallel to the barrel of the handgun when in place at the front of the holster. The stiffener is generally flat at the uppermost region when the holster is worn vertically, but forms a generally U or V-shaped groove toward the muzzle region. This U-or V-shape is achieved by a stitch line extending from the bottom region of the holster to an intermediate region. The U or V-shape results from the stitch line compressing the composite fabric locally which exerts deflecting force on the edges of the stiffener strip. The stiffener strip may be covered with a low friction cover.

The stiffener may be preformed as well and secured in place by a stitch line or lines at the bottom of the holster. In an alternate embodiment, the stiffener is preformed to a U or V shape and may not depend on stitching for its sight protecting and stiffening capabilities.

BRIEF DESCRIPTION OF THE DRAWING

This invention may be more clearly understood from the following detailed description and by reference to the drawing in which:

FIG. 4 is a rear side elevational view of the holster of FIG. 1 with the belt loop opened;

FIG. 5 is an inside plan view of a separable strap which may form a part of this invention;

FIG. 6 is a front elevational view of the holster of FIG. 1;

FIG. 7 is a fragmentary rear elevational view of the holster of FIG. 1 with the strap of FIG. 5 in place;

FIG. 8 is a similar view of FIG. 7 with the strap adjusted differently;

FIG. 9 is a plan view of a fabric cover used with the stiffener of this invention;

FIG. 10 is a fragmentary perspective view of the fabric cover of FIG. 9;

FIG. 11 is a plan view of the stiffener of this invention;

FIG. 12 is a fragmentary perspective view of the stiffener;

FIG. 12A is a fragmentary perspective view of an alternate embodiment of the stiffener of this invention;

FIG. 13 is a front elevational view of the stiffener of FIG. 11 in its final configuration in the holster;

FIG. 13A is a side elevational view of the final configuration of the stiffener of FIG. 13;

FIGS. 14A, 14B and 14C constitute sectional views of the stiffener of FIG. 13 taken along lines 14A, B and C of FIG. 13;

FIG. 15 is a perspective view of an alternate embodiment of the stiffener of this invention;

FIG. 16 is a top view of the holster of FIG. 1;

FIG. 17 is a horizontal sectional view of the holster of FIG. 1 taken along line 17—17 of FIG. 2; and FIGS. 18 and 19 are fragmentary opposite side elevational views of the holster of this invention partly in section showing an alternate method of securing the stiffener in place.

DETAILED DESCRIPTION OF THE INVENTION

Holster Generally

Figure 1:
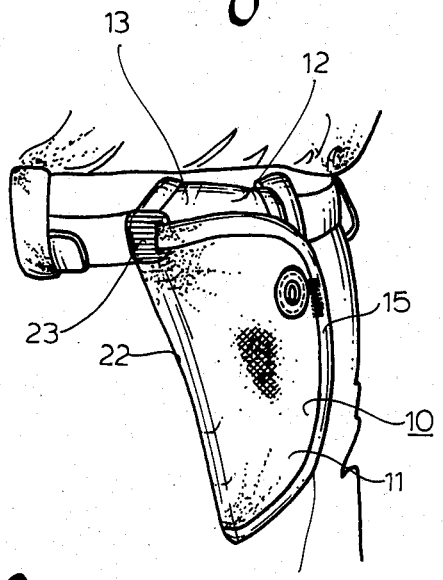
FIG. 1 is a perspective view of a holster of this invention without strap as shown carried on a belt.

Now referring to FIG. 1, an improved fabric holster 10 may be seen as including a folded and sewn sheet 11 of composite material formed to define a pouch-like opening 12 into which a handgun may be inserted for carrying. The actual shape of the holster 10 will vary depending upon the handgun or handguns for which it is intended to be used. In the embodiment shown, holster 10 is a smaller holster particularly designed for carrying 2" and 3" small and medium frame double action revolvers. Larger holsters incorporating these same inventive features are capable of carrying medium and large frame revolvers up to 5½".

The holster 10 is designed to be worn on a belt and therefore includes a belt loop 13, which in this case is formed integrally as a part of the sheet 11. The cut and unformed shape of the holster 10 appears in FIG. 1A. The belt loop 13 constitutes an extension of the sheet 11 and is sewn to the inner side of the holster 10 prior to the sewing of the edge seam 15. The belt loop is sewn to the inner side 14 of the holster by a pair of stitch lines 16 of FIG. 2. Also stitched to the inner side of the holster 10 and appearing in FIG. 2 is a cover of one fabric part 20 of a hook and eye fabric of the type commonly referred to by the trademark "Velcro". The fabric part 20 is sewn or otherwise attached to the inner side 14 of the holster 10 in the area which falls within the belt loop 13 when the holster is finally formed. This provides a feature of this invention which is described below in connection with FIG. 6.

Figure 3:
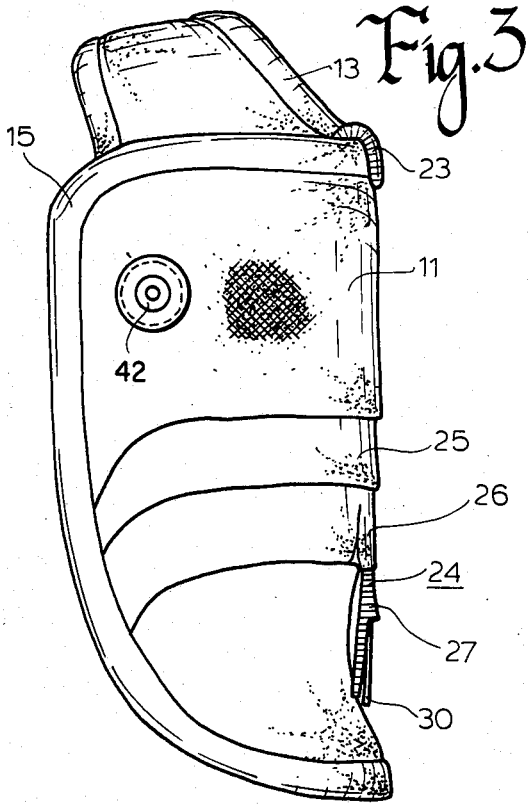
FIG. 3 is an outer side elevational view of a holster in accordance with this invention with portions cut away.

Referring again to FIG. 1 in connection with FIG. 3, the front face 22 of the holster 10 appears generally flat at the uppermost region near the top opening 12. At the top front a distinctive tab may be seen. Its color contrasts with the color of the holster, and its extension over the front of the holster 10 is for the maker identification purposes, and nonfunctional in the front region. The tab 23, however, is the upper end of a sight protecting guide assembly 24, better seen in FIGS. 3 and 9 through 16.

The basic construction of the holster is best seen in FIG. 3. The sheet 11 actually is a composite made up of an outer layer of the material known as ballistic nylon. It is a tightly woven fabric commonly used in light weight personal protection vests. Beneath the nylon cover is a layer 25 of closed cell foam in the order of 3/16 in. (6 mm) in thickness. The foam is preferably of a material such a polyurethane or polyethylene.

The foam layer 25 provides body and the requisite amount of stiffness in the holster and exhibits a high degree of resiliency to protect and form around the handgun while presenting a smooth outer surface for the nylon covering.

The inner liner 26 of the holster, which is in contact with the handgun, is preferably impregnated nylon fabric of a finer weave than the ballistic nylon which forms the outer surface of the holster 10. The inner nylon layer 26 actually extends out of the holster and is the outer covering 26 of the belt loop 13.

Stiffener Feature

Clearly visible in the cutout region of the holster 10 in FIG. 3 is the assembly 24. It comprises a fabric cover 27, which at its upper end defines the tab 23, and throughout its remaining length covers a plastic rib 30, with for example, 0.020 inch polyethylene (0.5 mm), approximately 15/16th inch (2.5 cm) wide and 6 inches (15.2 cm) in length. The sleeve 27 may best be seen in FIG. 9 and 10. It comprises a fabric tube, dimensioned to snugly enclose the stiffener 30, shown in FIGS. 11 and 12.

The actual installed relationship of the stiffener 30 and sleeve 26 as illustrated in part in FIG. 3, is located at the front of the holster 10 and generally defines a flat front to the holster, best seen in FIGS. 1 and 16. The generally flat front is due in large part to the presence of the stiffener 30.

Since most handguns carried in holsters of this type are generally reduced in transverse dimension at the muzzle region and maximum in transverse dimension at the rear, the shape of the holster 10 conforms to this general shape. This is accomplished using the stiffener 30.

Referring now to FIGS. 15 and 16, the generally flat front at the top of the holster is apparent just inside of the front tab 23. This corresponds to the general shape of the frame of the handgun in the chamber region. The muzzle region of the holster 10 appears in FIG. 16 in which the stiffener 30 and its sleeve 27 are concave or angled inward to define generally curved front region for the muzzle of the handgun.

Figure 1A:
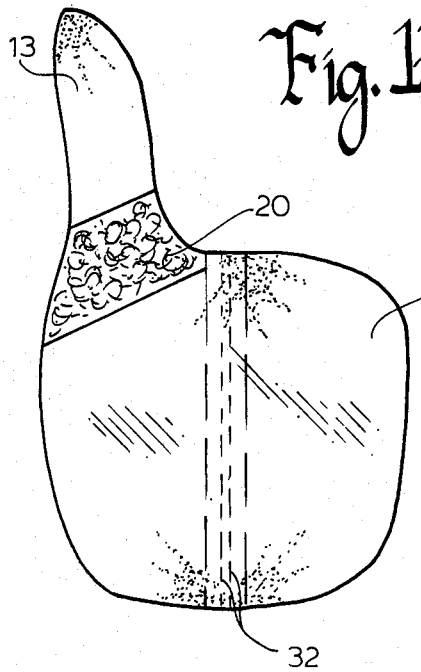
FIG. 1A is an outside plan view of the holster body in an unfolded condition.
Figure 2:
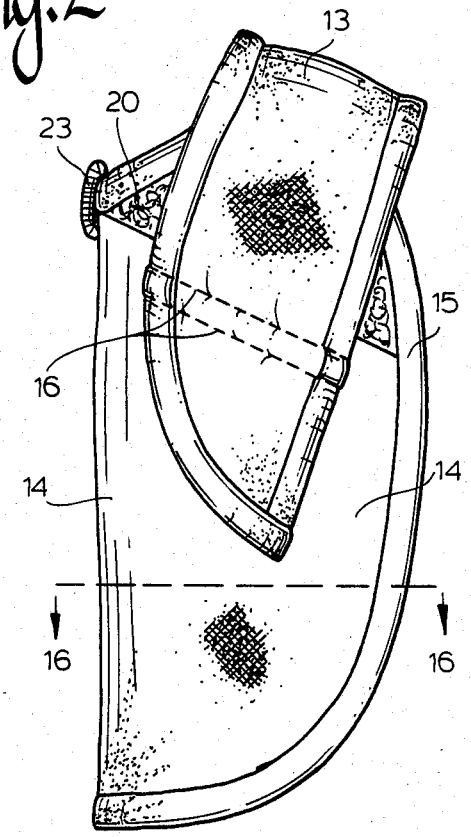
FIG. 2 is a rear (inner) side elevational view of the holster of FIG. 1.

The shaping of the muzzle region, shown in FIG. 16, is achieved by the simple and effective step of making two stitch lines 32 in the front center of the cut blank 11 of FIG. 1A to sew the stiffener assembly 24 to the sheet blank 11. The stitch lines 32 extend from the bottom region to near, but not reaching the top of the holster. These stitch lines compress the foam layer and provide a perforated line through both the foam and the stiffener to allow bending of the stiffener 30 inward to define the smaller round muzzle region. The general appearance of the stiffener 30 and its stitch lines 32 appears in FIGS. 13 and 14. Note in FIG. 14 that the lower two sections are angled or concave in shape.

The top of the stiffener 30 may be curved into a hook 30H as illustrated in FIGS. 13A and 15. This hook is located within the sleeve 27 and extends over the top front of the holster within the tab 23. This hook portion 30H maintains the top front of the holster stiff and of fixed opening width.

FIGS. 18 and 19 illustrate the fact that the stiffener 30 may be held in place at the bottom of the holster 10 by a stitch line 29 along the bottom of the holster. In FIG. 18, the stiffener 30A stops above the bottom of the holster 10 but the sleeve 27 extends below and is subsequently trimmed off. When the pouch forming stitch line 29 is sewn, it sews the sleeve 27 in place. In FIG. 19, the stiffener 30B is itself held in place by the stitch line 29. We have found that polyethylene or similar plastic strips can be sewn in place even if the sleeve 27 does not extend the full length of stiffener 30.

Strap Feature

Referring now specifically to FIGS. 5 and 6, the holster 10 is shown worn on a belt 50, shown in cross section. The belt 40 presses against the outer surface of strap 40 thereby forcing its hook and eye fastener part into closer engagement with its mating part 20 attached to the holster body. Therefore, not only is complete adjustability of position and tightness of the strap 30 possible employing this invention, but the actual wearing of the holster applies positive locking pressure to the strap connection at all times. Prior attempts to use hook and eye fabric connections for holster straps have not achieved this advantage.

Now referring to FIG. 5, the totally separable strap 40 may be seen. It is fabricated of fabric strapping material such as nylon or polyester and includes a snap fastener part 41 which mates with the part 42 attached to the holster body 11 and shown in FIGS. 1 and 3. The strap 40 includes at its opposite side on the same side as the fastener 41, a section of hook and eye fabric 43 which mates with the opposite part 20 on the inner face 14 of the holster 10 as shown in FIGS. 2, 7, and 8. In the example given, the pile type fabric is shown at 20 and the hook type fabric is shown at 43. These could be interchanged if desired. It should be noted by reference to FIG. 1A that the pile fabric covers a substantial area of the inner face of the side 14 beneath the belt loop 13. This allows a feature of this invention which is best illustrated in FIGS. 6, 7, and 8.

Referring now to FIGS. 7 and 8, the strap 40 may be seen as secured to different areas of the pile fabric 20 and particularly at different angles and different lengths to accommodate different handguns and preferred ways of strapping the handgun.

The total flexibility of the strap 40 also accommodates handguns with special or oversize hammers. Once the user experiments with the correct angle and length of the strap, merely pressing the part 43 against the appropriate area of the part 20, the parts 20 and 43 engage and thereafter when the holster is placed on a belt 50 through the belt loop 13, the restricted belt loop causes the belt 50 to firmly press the strap 40 against the fabric 20.

The strap is firmly secured as if it were permanently attached to the holster body. The position and length may be easily changed merely by removing the holster from the belt 50, making the adjustment and remounting the holster 10 on the belt 50.

In FIG. 6, the belt 50 fairly well filling the belt loop 13 opening bears against the inner surface of the belt loop 13 against the trousers, and the belt's outer surface bears against the outer surface of the strap 40, which in turn bears against the hook and eye fabric part 20 attached to the holster body 11. All bulky fasteners for belts have been eliminated adding to the compactness of this invention.

The end result is a holster which is effective in holding and protecting the handgun, attractive to view and reasonably inexpensive to manufacture. It is relatively undamaged by immersion in water and after drying out is as useful and attractive as new. It is totally adjustable in strap angle and provides stiffness for the holster as well as sight protection.

What is claimed is:

1. A holster comprising a sheet of compressible material formed into a pouch to hold a handgun and including an opening for the insertion and removal of a handgun therefrom;

said sheet of material being folded together and secured at the edge regions to define the pouch;

support means secured to said sheet of material whereby said holster may be carried on the wearer; and stiffener means secured to the inside of said folded sheet;

wherein the means securing said stiffener means to said sheet comprises at least one stitch line extending from the bottom region of said holster to an intermediate region thereof through said stiffener means, locally compressing said sheet of compressible material whereby said compressible material causes bending of said stiffener inwardly along a major portion of its length to define a channel for the muzzle of a handgun within said holster.

2. The combination in accordance with claim 1 in which said stiffener means comprises a planar sheet of plastic of length approximating the height of the holster and width approximating the maximum lateral dimension of the handgun frame to be carried in the holster, and of thickness sufficient to prevent crushing of the holster front in normal use and yet distortable about said stitch line to define a concave front of the interior of said pouch.

3. The combination in accordance with claim 2 wherein said sheet comprises a pair of outer and inner layers of fabric and an intermediate layer of foam whereby said stitch line compresses said foam in the intermediate layer to lower regions of the interior of the pouch with the upper front region beyond the upper end of said stitch line of the holster having a generally planar front.

4. The combination in accordance with claim 1 wherein said stiffener is preformed into a generally channel shape.

5. The combination in accordance with claim 4 wherein said generally channel shaped stiffener is of extruded resilient plastic.

6. A holster comprising a sheet of material formed into a pouch to hold a handgun and including an opening for the insertion and removal of a handgun therefrom;

said sheet of material being folded together and secured at the edge regions to define the pouch;

support means secured to said sheet of material whereby said holster may be carried by the wearer; and longitudinally extending and sufficiently flexible stiffener means secured to the inside of the folded sheet to allow the formation of said longitudinal stiffener means in at least the muzzle region of the holster into a concave shape to define a smaller, substantially round muzzle region;

wherein the means securing said stiffener means to said folded sheet includes a tubular sleeve enclosing said stiffener and protecting said stiffener from contact with a handgun in the holster.

7. The combination in accordance with claim 6 wherein said sleeve is secured to said holster by at least one stitch line.

8. The combination in accordance with claim 7 wherein said one stitch line comprises the stitch line securing said edge regions to define the pouch for the handgun.

9. The combination in accordance with claim 5 wherein said sleeve is secured to said holster by a vertical stitch line along the front of the holster, said stitch line defining a fold line for said stiffener to produce a recess for the sights of a handgun carried in the holster.

10. The combination in accordance with claim 6 wherein said securing means comprises a pair of parallel vertical stitch lines.

11. The combination in accordance with claim 6 wherein said securing means comprises a stitch line in the bottom region of said sleeve securing said sleeve and the stiffener therein to the bottom region of the holster.

12. The combination in accordance with claim 11 wherein said stitch line comprises a stitch line securing the edge regions of said holster to define the pouch thereof.

13. The combination in accordance with claim 6 wherein said stiffener means extends over the top front of said holster beyond said stitch line to define the width of the front top of the holster.

14. The combination in accordance with claim 13 wherein said stiffener is preformed with a hook at the top thereof to define the portion which extends over the top of the holster and maintains the top front of the holster stiff and of fixed opening width.

* * * * *